US012800259B2

(12) United States Patent
Bubits

(10) Patent No.: US 12,800,259 B2
(45) Date of Patent: Nov. 17, 2026

(54) SHOULDER STOCK FOR HAND FIREARMS

(71) Applicant: Werner E. Heeb, Wangen (CH)

(72) Inventor: Wilhelm Bubits, Lutzmannsburg (AT)

(73) Assignee: WERNER E. HEEB, Wangen (CH)

( * ) Notice: Subject to any disclaimer, the term of this patent is extended or adjusted under 35 U.S.C. 154(b) by 0 days.

(21) Appl. No.: 19/122,110

(22) PCT Filed: Oct. 20, 2023

(86) PCT No.: PCT/AT2023/060368

§ 371 (c)(1),
(2) Date: Apr. 17, 2025

(87) PCT Pub. No.: WO2024/081993

PCT Pub. Date: Apr. 25, 2024

(65) Prior Publication Data

US 2026/0126267 A1 May 7, 2026

(30) Foreign Application Priority Data

Oct. 20, 2022 (AT) ..... A 198/2022

(51) Int. Cl.
*F41C 23/12* (2006.01)
*F41C 23/04* (2006.01)

(52) U.S. Cl.
CPC ..... *F41C 23/12* (2013.01)

(58) Field of Classification Search
CPC ..... F41C 23/04; F41C 23/12
See application file for complete search history.

(56) References Cited

U.S. PATENT DOCUMENTS 22,626 A * 1/1859 Colt ..... F41C 23/12 42/72
28,433 A * 5/1860 Alsop ..... F41C 23/04 42/72
1,016,695 A * 2/1912 Kimmel ..... F41C 23/12 42/72

(Continued)

FOREIGN PATENT DOCUMENTS

AT 410141 B 2/2003
AT 514689 B1 3/2015

(Continued)

OTHER PUBLICATIONS

International Search Report and Written Opinion received for PCT/AT2023/060368, mailed Jan. 24, 2024.

(Continued)

*Primary Examiner* — Derrick R Morgan
(74) *Attorney, Agent, or Firm* — Greer, Burns & Crain, Ltd

(57) ABSTRACT

A shoulder stock for pistols, consisting of an elongated body, having a rear end that forms a first support surface for contact against a shoulder region of a shooter and having a front end that forms a hand grip for the hand of the shooter as well as a second support surface for receiving an entire reaction force of the pistol, is intended to enable the use of various handguns with differently shaped grip pieces with only one shoulder stock, with minimal effort. For this purpose, the entire hand grip is replaceable and makes it possible to use different pistols with only one elongated body.

8 Claims, 5 Drawing Sheets

(56) References Cited

U.S. PATENT DOCUMENTS 1,276,572 A * 8/1918 Rogers ..... F41C 23/12 42/72
1,307,594 A * 6/1919 Newman ..... F41A 1/04 42/106
1,334,467 A * 3/1920 Moller ..... F41C 23/06 42/74
1,477,445 A * 12/1923 Petritsch ..... F41C 23/12 42/72
1,557,865 A * 10/1925 Neel ..... F41C 23/12 D21/573
1,651,299 A * 11/1927 Stansel ..... F41C 23/14 42/73
1,877,016 A * 9/1932 Munson ..... F41C 23/12 15/104.165
2,139,691 A * 12/1938 Michal, Jr. ..... F41C 23/10 89/33.02
2,433,151 A * 12/1947 Parsons ..... F41C 23/12 42/72
2,956,343 A * 10/1960 Shaffer ..... F41C 23/14 33/506
3,184,877 A * 5/1965 Andrews ..... F41C 23/12 42/72
3,200,528 A * 8/1965 Christensen ..... F41C 23/12 224/185
3,233,354 A * 2/1966 Ahearn ..... F41C 23/06 42/74
3,267,923 A * 8/1966 Ronci ..... F41C 23/10 42/72
3,553,878 A * 1/1971 Canon ..... F41A 23/02 42/72
3,609,902 A * 10/1971 Casull ..... F41C 23/12 42/62
3,685,194 A * 8/1972 Coon ..... F41C 23/10 42/72
3,798,818 A * 3/1974 Casull ..... F41C 23/10 42/72
4,291,482 A 9/1981 Bresan
4,321,765 A * 3/1982 Gillum ..... F41C 23/10 42/72
4,989,358 A * 2/1991 Aronson ..... F41C 23/12 42/72
5,092,070 A * 3/1992 Perkins ..... F41C 23/12 42/72
5,183,952 A * 2/1993 Morales ..... F41C 23/10 42/72
5,778,588 A * 7/1998 Allen, III ..... F41C 23/12 42/72
5,924,233 A * 7/1999 Strobel ..... F41C 23/12 42/72
6,367,187 B2 * 4/2002 Bubits ..... F41C 33/0209 42/72
6,684,549 B2 * 2/2004 Bragg ..... F41C 23/08 42/74
7,386,952 B1 * 6/2008 Henretty ..... F41C 23/20 42/74
7,552,557 B1 * 6/2009 Mabry ..... F41A 11/04 42/71.01
7,937,874 B2 * 5/2011 Roth ..... F41C 23/10 42/72
8,205,374 B2 * 6/2012 Lamm ..... F41C 23/12 42/72
8,438,771 B1 * 5/2013 Boone ..... F41A 11/02 42/72
8,448,366 B2 * 5/2013 Faifer ..... F41G 11/003 42/72
8,677,669 B1 * 3/2014 Vesligaj ..... F41C 23/12 42/75.01
9,188,406 B2 * 11/2015 DenBleyker ..... F41C 23/20
9,869,524 B2 * 1/2018 Bubits ..... F41C 27/20
9,933,232 B2 * 4/2018 Gilmer ..... F41C 3/14
10,054,393 B2 * 8/2018 Kedairy ..... F41C 23/12
D900,271 S * 10/2020 Faifer ..... D22/108
10,830,557 B2 * 11/2020 Faifer ..... F41C 23/12
11,156,433 B2 * 10/2021 Griffith ..... F24F 11/72
11,193,724 B1 * 12/2021 McCarthy ..... F41C 23/10
2002/0007579 A1 * 1/2002 Bubits ..... F41C 23/12 42/72
2009/0282718 A1 * 11/2009 Bartley ..... F41C 23/12 42/75.03
2010/0154272 A1 * 6/2010 Lamm ..... F41C 23/12 224/676
2010/0263254 A1 * 10/2010 Glock ..... F41C 23/10 42/72
2011/0107644 A1 * 5/2011 Faifer ..... F41C 23/12 42/75.02
2012/0131829 A1 * 5/2012 Fistikchi ..... F41C 23/22 42/1.06
2013/0036645 A1 * 2/2013 Chvala ..... F41C 23/20 42/73
2014/0250755 A1 * 9/2014 Hogue ..... F41C 23/10 42/71.02
2015/0068097 A1 * 3/2015 DenBleyker ..... F41C 23/20 42/94
2016/0061558 A1 * 3/2016 Gilmer ..... F41C 23/12 42/71.02
2016/0116249 A1 * 4/2016 Maugham ..... F41C 23/08 42/74
2017/0045330 A1 * 2/2017 Bubits ..... F41C 27/20
2017/0153084 A1 * 6/2017 Tarazi ..... F41A 9/65
2017/0241737 A1 * 8/2017 Keller, II ..... F41A 3/66
2019/0063868 A1 * 2/2019 Rich ..... F41C 23/10
2019/0257613 A1 * 8/2019 Burkhart, III ..... F41C 23/12
2020/0158458 A1 * 5/2020 Faifer ..... F41C 23/04
2021/0180911 A1 * 6/2021 Porat ..... F41C 23/04
2023/0081853 A1 * 3/2023 Butler ..... F41C 27/00 42/72
2025/0271236 A1 * 8/2025 Botach ..... F41C 23/12

FOREIGN PATENT DOCUMENTS

CH 120280 A 5/1927
WO 2015161334 A1 10/2015

OTHER PUBLICATIONS

Office Action and Search Report received for Austrian Application No. A 198/2022/1 dated Nov. 14, 2022.

* cited by examiner

SHOULDER STOCK FOR HAND FIREARMS

BACKGROUND

The invention relates to a shoulder stock for pistols, consisting of an elongated body whose rear end has a first support surface for contact against the shoulder region of the shooter and whose front end has a hand grip for the shooters hand as well as a second support surface for receiving the reaction force of the pistol.

Known shoulder stocks for pistols are detachably fastened to the grip piece or to the housing of the respective pistol. As a result, the pistol shooter benefits from the advantages of a standard rifle, for example an increase in shooting accuracy. Such shoulder stocks are known from U.S. Pat. Nos. 8,438,771 and 4,291,482.

In patent AT 410141 of the applicant, a shoulder stock is described whose lower strut engages in a guide specially created for this purpose on the grip piece, and whose upper strut forms a contact surface for the grip piece. Because the shooters hand during use only encompasses the pistols grip piece, the stability of the connection is limited by the bending stiffness of the lower strut.

All these shoulder stocks share the disadvantage that their assembly and disassembly require skill and increased training. In an operational scenario, this can present a problem. Further-more, such shoulder stocks must be attached in such a way that the slide's recoil is not impeded. This either impairs the feel of the grip (see U.S. Pat. No. 8,438,771) or requires design measures on the pistol (see U.S. Pat. No. 4,291,482). Moreover, these shoulder stocks are each designed for connection with a specific pistol.

From patent AT 514689 of the applicant, a shoulder stock is known which comprises a hand grip for the shooters hand and a support surface for receiving the reaction force, and the connection with the pistol is made by the shooters hand. The hand grip forms a forwardly open recess into which the contour of the rear part of the pistols grip piece fits. The free space in front of the hand grip accommodates the shooting hand, so that the shooter can encompass the hand grip together with the grip piece, which is received by the hand grip, using one hand. The grip piece and the hand grip are held together by the shooters hand, meaning that no additional connecting element and no locking mechanism are required.

The disadvantage here is that the shoulder stock only fits one particular weapon. Producing various shoulder stocks for different hand firearms is not expedient due to the high tooling costs for plastic injection-molded parts.

It is therefore the object of the invention to enable, with minimal effort, the use of different handguns with different grip piece shapes using only a single shoulder stock.

SUMMARY

According to the invention, the front part of the shoulder stock, that is, the hand grip area, is interchangeable, with its shape adapted to the respective pistol grip. This allows the shoulder stock to be used with different weapons. In this preferred embodiment, the elongated body branches at the front into two arms, and the hand grip is a grip element attachable to the ends of the arms, with the arms and the hand grip being connected by longitudinally oriented plug pins. In this embodiment, very wide or narrow pistol grip pieces, or pistols with unusual grip shapes, can be used. The plug pins fit into an opening of the respective other part and can be secured by pins arranged transversely to the firing direction. A forwardly open recess bounded by side walls positions the pistol and provides support so that it can be quickly and securely grasped at the same time as the hand grip and brought into the in-use position.

In a variant of the preferred embodiment, the hand grip in a one-piece shoulder stock forms a forwardly open recess into which an insert part can be placed, into whose front contour the rear contour of the grip piece of a pistol fits. In any event, the rear contour of the insert part corresponds to the shape of the forwardly open recess of the hand grip. The front contour of the insert part corresponds to the grip shape of the respective weapon. Thus, the shoulder stock can be used with different weapons by selecting and exchanging a small part. The insert part can be made of any materials, for instance also of an elastic material for damping recoil. It could be joined to the hand grip by gluing, latching, snapping in, or screwing, preferably by pins arranged transversely to the firing direction. It consists of a base extending over the entire length of the recess, of an upper hook that forms a contact surface acting in the vertical direction, and of side walls. The width of the base of the insert part corresponds to the inner clearance of the forwardly open recess of the hand grip.

BRIEF DESCRIPTION OF THE DRAWINGS

Below, the invention is described and explained on the basis of figures of two embodiments. These are showing.

DETAILED DESCRIPTION

Figure 1:
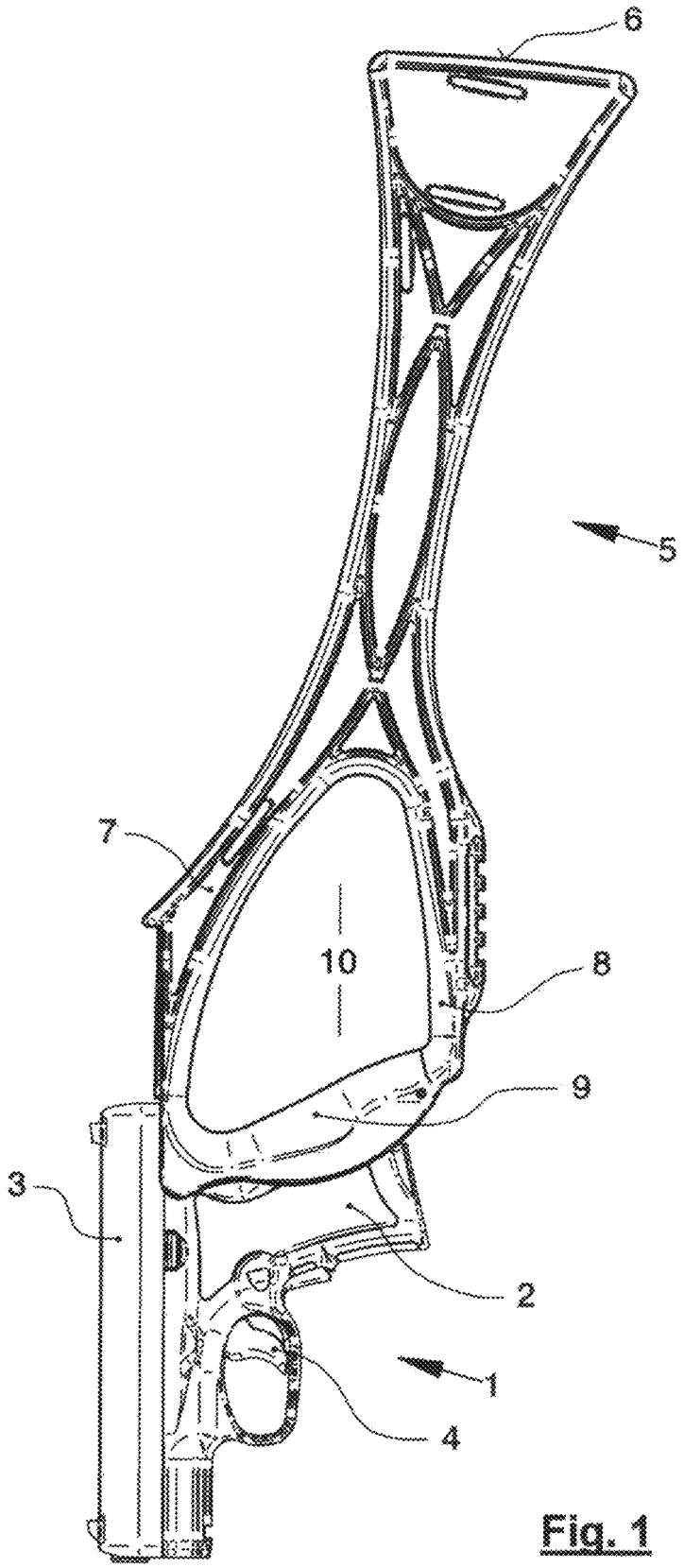
FIG. 1: A shoulder stock with pistol in the in-use position.

In FIG. 1, a pistol is generally labeled 1 and a shoulder stock is generally labeled 5, the pistols grip piece with 2, its slide with 3, and its trigger with 4. The shoulder stock 5 is an elongated injection-molded part made of a suitable plastic with reinforcing ribs, which at its rear end forms a first support surface 6 for contact against the shooters shoulder region. Toward the front, it branches into two struts 7, 8, whose ends transition into a hand grip 9.

The two arms 7, 8 and the hand grip 9 enclose a free space 10 for the shooters hand, which alone holds together the hand grip 9 and the pistols grip piece 2.

Figure 2:
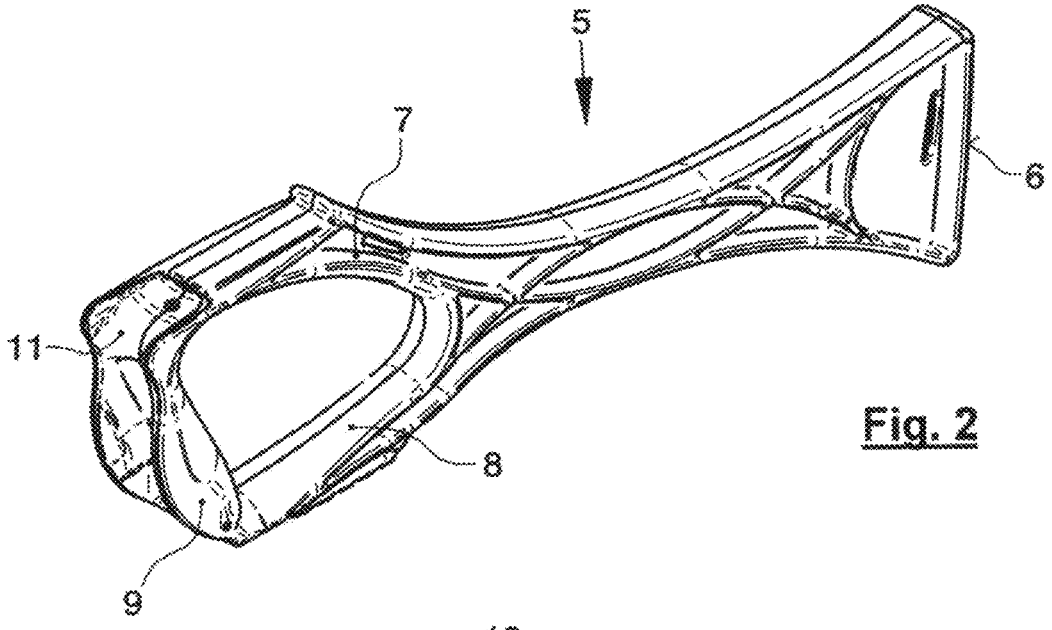
FIG. 2: The shoulder stock in a first embodiment.
Figure 3:
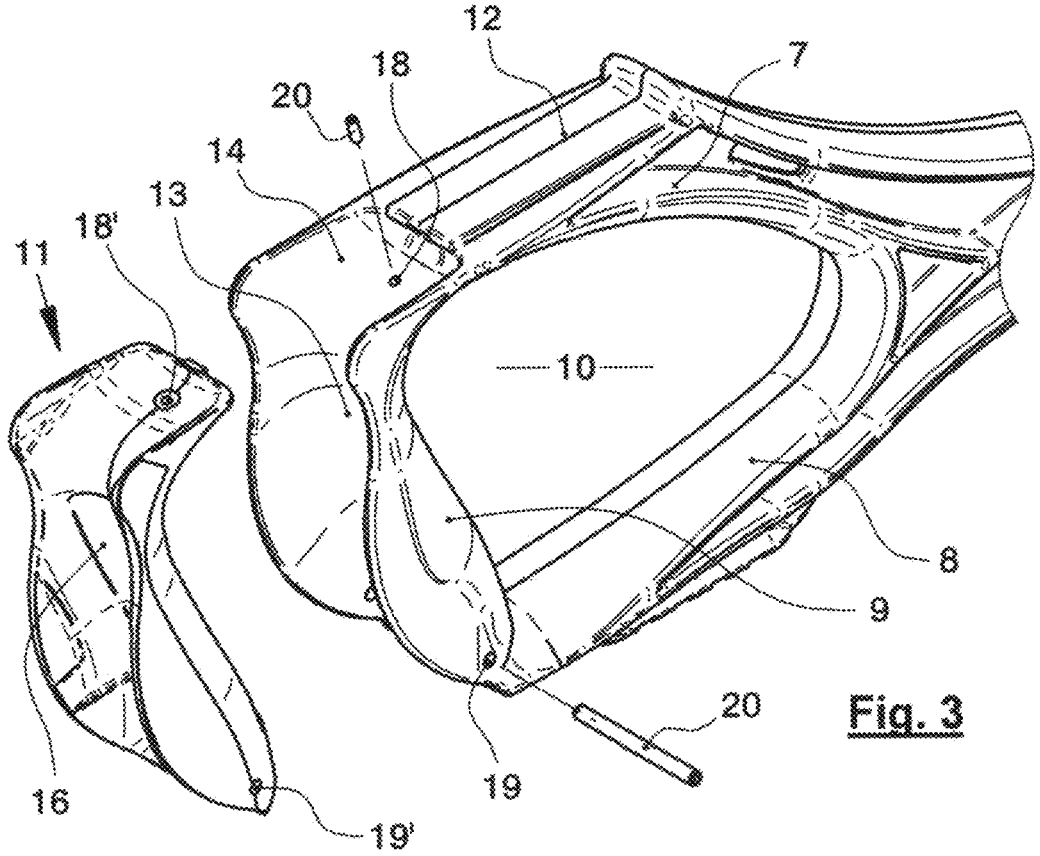
FIG. 3: Its front part, enlarged and exploded.
Figure 6:
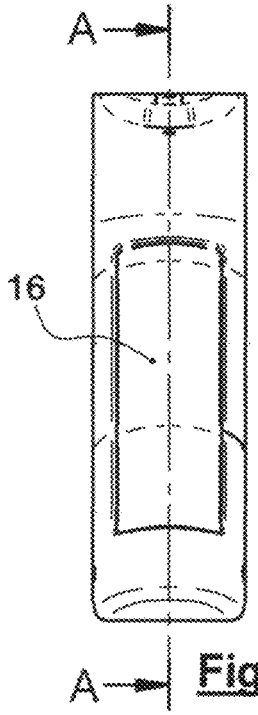
FIG. 6: The same seen from behind.
Figure 4:
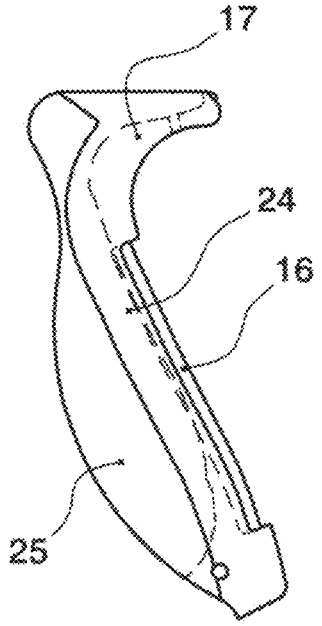
FIG. 4: The insert part in side view.
Figure 8:
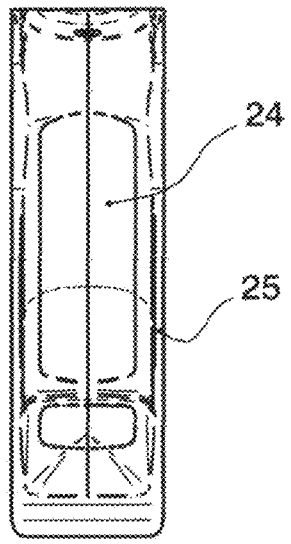
Figure 5:
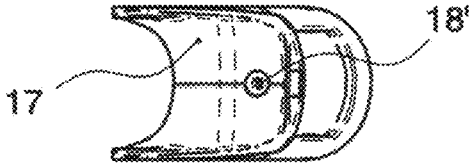
FIG. 5: The same in top view.

In FIG. 2, the shoulder stock 5 with the attached insert part 11 can be seen, and in FIG. 3 it can be seen enlarged with the insert part 11 removed. The upper strut 7 has a flattening 12 at the top to provide clearance for the recoiling slide 3. The hand grip 9 forms a forwardly open recess 13, which at the top has a rearward extension 14. The horizontal section through the recess can be rectangular. In this recess 13, an insert part 11 is form-fittingly inserted (FIG. 2).

In any event, the rear contour of the insert part 11 corresponds to the shape of the forwardly open recess 13, 14 of the hand grip 9. Its front contour corresponds to the rear contour of the respective pistols grip piece 2; it forms a second support surface 16. At its upper end, the insert part 11 has a rearward projection 17, which extends into the extension 14 of the recess 13 of the hand grip 9 and thus facilitates vertical positioning of the insert part 11. For the firm connection of the insert part 11 with the hand grip 9, there are bores 18, 19, 18', 19' arranged transversely to the firing direction in both parts for pins, in particular spring pins 20. Bore 18 is approximately vertical, and bore 19 is horizontal.

Generally, "front" refers to the side facing the target, and "rear" refers to the side facing the shooter.

Figure 7:
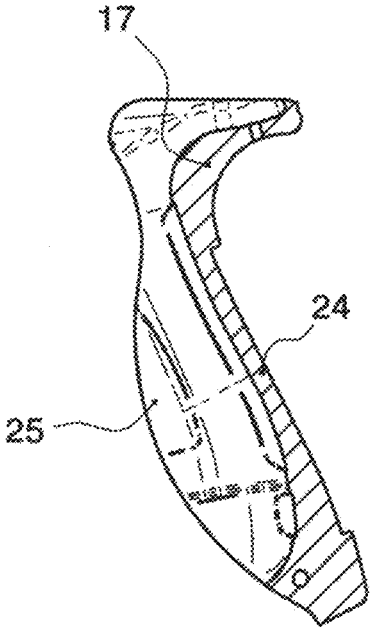
FIG. 7: The same in section along AA in FIG. 5,
FIG. 8: The same seen from the front.

In FIGS. 4, 5, 6, and 8, the insert part 11 is shown from the side, from the front, from the rear, and from above; in FIG. 7 in section. The recess 13 of the hand grip 9 and its extension 14 can be rectangular, U-shaped, or oval in cross section. Corresponding to the shape of recess 13, the rear contour of insert part 11 is formed by a base 24 with the projection 17 at the top and one tab 25 on each side. The tabs 25 enclose the pistols grip piece 2 and provide lateral support.

After removing the spring pins 20, the insert part 11 is easy to exchange with just two manipulations. This allows a different insert part 11 to be used for other pistol models.

Figure 9:
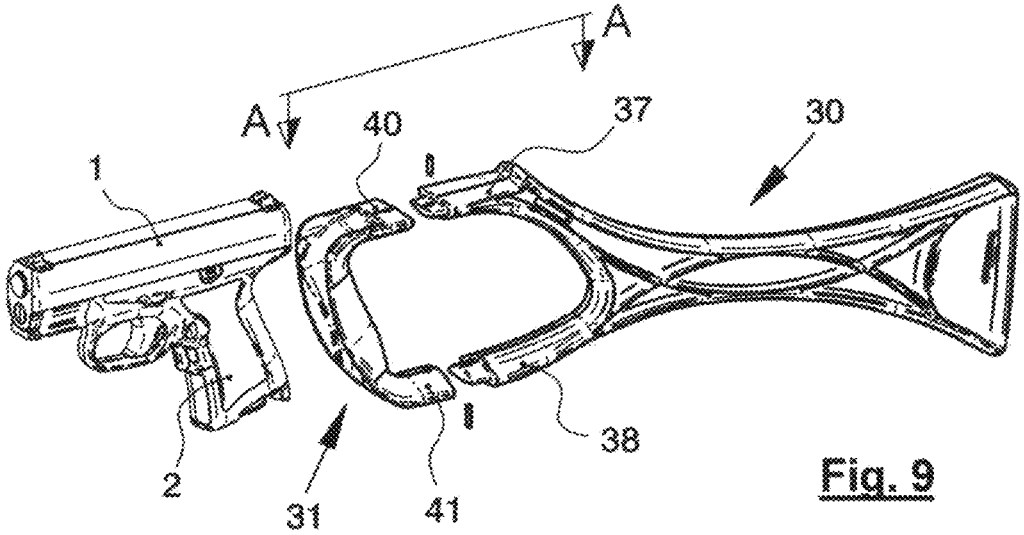
FIG. 9: The shoulder stock in the preferred embodiment, exploded.

In FIG. 9, the preferred shoulder stock 30 and the hand grip 31 are shown. In its basic form, the shoulder stock 30 corresponds to that of the first embodiment, however, the arms 37, 38 at the front have free ends onto which the two curved sections 40, 41 of the hand grip 31 are attached.

Figure 10:
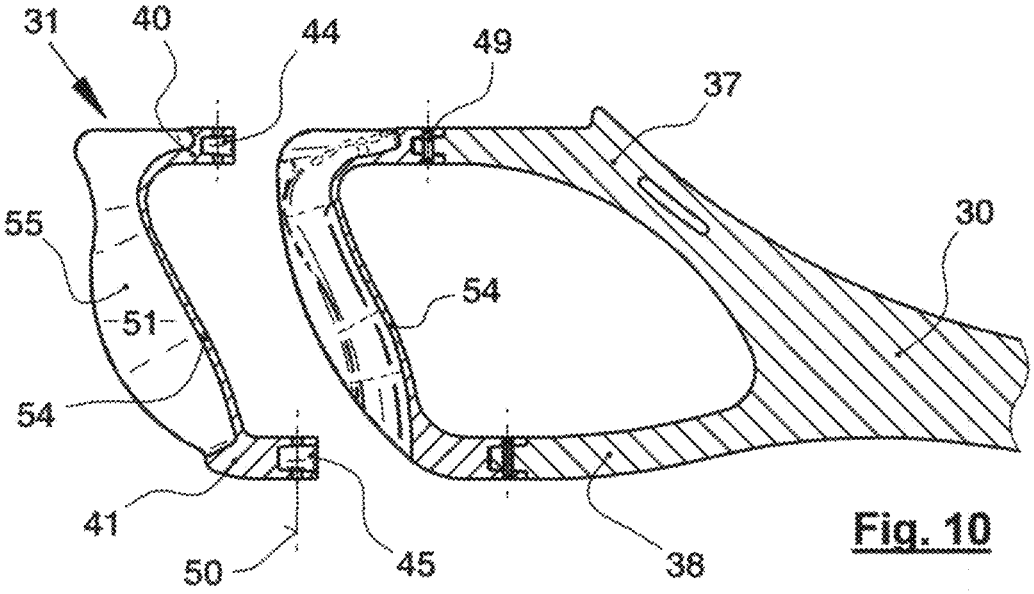
FIG. 10: A longitudinal section along AA in FIG. 9,
FIG. 11: An axonometric view of FIG. 10.
Figure 11:
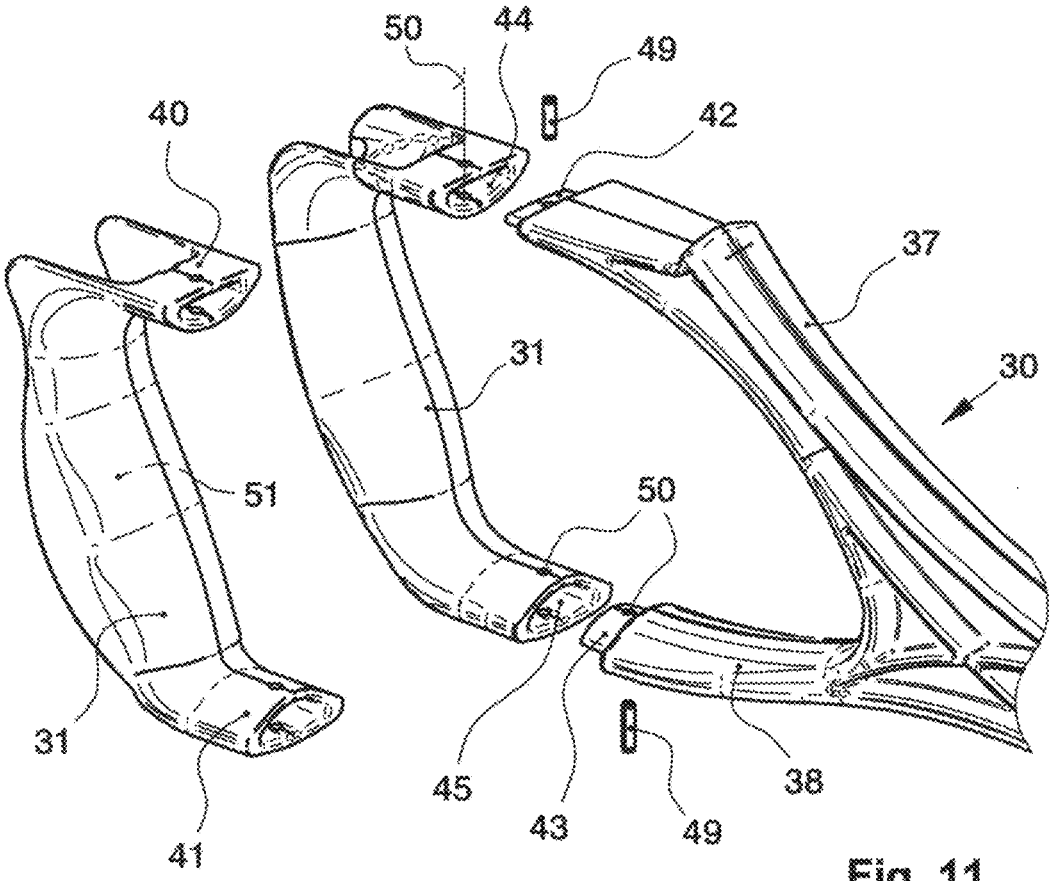

In FIG. 10 and FIG. 11, it can be seen that the plug pins 42, 43 at the ends of arms 37, 38 fit into corresponding slots 44, 45 of the hand grip 31. Cylindrical pins 49 in transverse bores 50 serve for securing.

The hand grip 31 is a bracket. It consists of an approximately vertical base 54, against which the shooters palm rests on the rear, i.e. outside, above and below which the curved sections 40, 41 connect, and of side walls 57, which form a forwardly open recess 51. Its shape corresponds to that of the rear part of the respective pistols grip piece (2). The slots 44, 45 are located at the front ends of the curved sections 40, 41, but can also be located at the ends of arms 37, 38.

FIG. 11 indicates that by keeping variously shaped hand grips 31 available, the use of different pistols is possible.

It is within the scope of the invention that the technical solutions described above can also be applied to revolvers and machine pistols.

REFERENCE SIGNS

1 Pistol
2 Grip piece
3 Slide of 1
4 Trigger of 1
5 Shoulder stock
6 First support surface
7 Upper strut
8 Lower strut
9 Hand grip 9 in FIGS. 1, 2, 3
10 Free space
11 Insert part
12 - - -
13 Recess in 9
14 Extension of 13
15 - - -
16 Second support surface
17 Projection of 11
18 Vertical bore in 9 and 18' in 11
19 Horizontal bore in 9 and 19' in 11
20 Pin in 18, 19
21 - -
22 - - -
23 - - -
24 Base
25 Tab
26 - - -
30 Shoulder stock in preferred embodiment
31 Hand grip 31 in FIGS. 9, 10, 11
37 Upper arm of 30
38 Lower arm of 30
40 Upper curved section, end of 31
41 Lower curved section, end of 31
42 Plug pin
43 Plug pin
44 Slot for 42
50 Openings for 49
51 Recess
54 Base
55 Side walls

The invention claimed is:

1. A shoulder stock for pistols, consisting of an elongated body, whose rear end forms a first support surface for contact against a shoulder region of a shooter, and having a front end that forms a hand grip for a hand of the shooter with a second support surface for receiving a reaction force of the pistol, the hand grip is replaceable and the handgrip shape is adapted to a grip shape of the respective pistol in use, or an insert part can be inserted into the hand grip, which fits a pistol grip piece, the elongated body is branched at the front into two arms, the hand grip can be attached to ends of the arms, the arms and the hand grip are connected by longitudinally oriented plug pins and the hand grip is connected to the arms by pins arranged transversely to the firing direction.

2. The shoulder stock according to claim 1, characterized in that the hand grip consists of a base and side walls, which form a forwardly open recess, which recess is adapted to the respective pistol in use.

3. The shoulder stock according to claim 1, characterized in that the hand grip presents a forwardly open recess into which an insert part can be fitted, into which insert part the pistol grip piece fits.

4. The shoulder stock according to claim 3, characterized in that the insert part is connected to the pistol hand grip by pins arranged transversely to a firing direction.

5. The shoulder stock according to claim 3, characterized in that the insert part consists of a base extending over an entire length of the recess, of an upper hook forming a contact surface acting in the vertical direction, and of side walls.

6. The shoulder stock according to claim 3, characterized in that the insert part consists of an elastic material.

7. A shoulder stock for pistols, consisting of an elongated body, whose rear end forms a first support surface for contact against a shoulder region of a shooter, and having a front end that forms a hand grip for a hand of the shooter with a second support surface for receiving a reaction force of the pistol, the hand grip is replaceable and the handgrip shape is adapted to a grip shape of the respective pistol in use, or an insert part can be inserted into the hand grip, which fits a pistol grip piece, the hand grip presents a forwardly open recess into which an insert part can be fitted, into which insert part the pistol grip piece fits, the insert part is connected to the pistol hand grip by pins arranged transversely to a firing direction.

8. A shoulder stock for pistols, consisting of an elongated body, whose rear end forms a first support surface for contact against a shoulder region of a shooter, and having a front end that forms a hand grip for a hand of the shooter with a second support surface for receiving a reaction force of the pistol, the hand grip is replaceable and the handgrip shape is adapted to a grip shape of the respective pistol in use, or an insert part can be inserted into the hand grip, which fits a pistol grip piece, the hand grip presents a forwardly open recess into which the insert part can be fitted, into which insert part the pistol grip piece fits, the insert part consists of a base extending over an entire length of the recess, of an upper hook forming a contact surface acting in the vertical direction, and of side walls.

* * * * *